US007007341B2

(12) United States Patent
Wang

(10) Patent No.: US 7,007,341 B2
(45) Date of Patent: Mar. 7, 2006

(54) DOOR CLOSER

(75) Inventor: Yu-Jen Wang, Tainan Hsien (TW)

(73) Assignee: Fu Luong Hi-Tech Co., Ltd., (TW)

( * ) Notice: Subject to any disclaimer, the term of this patent is extended or adjusted under 35 U.S.C. 154(b) by 83 days.

(21) Appl. No.: 10/779,488

(22) Filed: Feb. 13, 2004

(65) Prior Publication Data

US 2005/0177975 A1 Aug. 18, 2005

(51) Int. Cl.
*E05F 3/10* (2006.01)

(52) U.S. Cl. ..... 16/60; 16/71; 16/328; 16/DIG. 9; 16/53

(58) Field of Classification Search ..... 16/71, 16/53, 60, 328, 335, DIG. 9
See application file for complete search history.

(56) References Cited

U.S. PATENT DOCUMENTS 4,064,589 A * 12/1977 Bejarano et al. ..... 16/53
4,763,384 A * 8/1988 Watabe ..... 16/53
4,785,493 A * 11/1988 Tillmann et al. ..... 16/53
5,337,448 A * 8/1994 Brown ..... 16/53
5,802,670 A * 9/1998 Bienek ..... 16/53
6,442,795 B1 * 9/2002 Chen ..... 16/53
6,823,561 B1 * 11/2004 Park et al. ..... 16/320

* cited by examiner

*Primary Examiner*—Robert J. Sandy
*Assistant Examiner*—Michael J. Kyle
(74) *Attorney, Agent, or Firm*—Ostrolenk, Faber, Gerb & Soffen, LLP

(57) ABSTRACT

A door closer includes a closer casing, a pivot unit, and a length-variable damping cylinder. The pivot unit includes a pivot axle, a cam member, and a cam follower member. The pivot axle has a drive end portion that extends into and that is retained rotatably in the closer casing, and a coupling end portion that extends out of the closer casing. The cam member is mounted co-rotatably on the drive end portion of the pivot axle. The cam follower member is disposed in the closer casing, and is acted upon by the cam member. The damping cylinder is disposed in the closer casing, and has one end coupled to the cam follower member and an opposite end anchored to the closer casing.

11 Claims, 5 Drawing Sheets

DOOR CLOSER

BACKGROUND OF THE INVENTION

1. Field of the Invention

The invention relates to a door closer, more particularly to a door closer that ensures a smooth action when restoring a door panel to a closed position.

2. Description of the Related Art

Due to frequent entry and exit by work personnel and clients, a business premise is preferably installed with a door closer that can automatically restore a door panel to a closed position. There are many products currently available that provide a door structure with such a function, the constructions of which vary depending upon the installed position, such as lateral, top or bottom edges, relative to the door panel.

A conventional ground-type door closer generally includes a casing mounted with a pivot axle that is connected to a bottom side of a door panel. The casing is filled with hydraulic fluid that cooperates with a hydraulic speed regulating mechanism for controlling moving speed of the door panel, and a spring member is used to accumulate a restoring force to assist closing movement of the door panel.

SUMMARY OF THE INVENTION

The object of the present invention is to provide a door closer that does not require filling of a closer casing thereof with hydraulic fluid.

Accordingly, the door closer of this invention comprises a closer casing, a pivot unit, and a length-variable damping cylinder. The closer casing has first and second end portions opposite to each other in a longitudinal direction. The pivot unit includes a pivot axle, a cam member, and a cam follower member. The pivot axle has a drive end portion that extends into and that is retained rotatably in the first end portion of the closer casing, and a coupling end portion that extends out of the closer casing. The cam member is mounted co-rotatably on the drive end portion of the pivot axle. The cam follower member is disposed in the closer casing, and is acted upon by the cam member for moving along the longitudinal direction between open and closing positions upon rotation of the pivot axle. The damping cylinder is disposed in the closer casing, and has one end coupled to the cam follower member and an opposite end anchored to the second end portion of the closer casing. The damping cylinder accumulates a restoring force upon movement of the cam follower member from the closing position to the open position, and releases the restoring force to assist movement of the cam follower member from the open position back to the closing position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
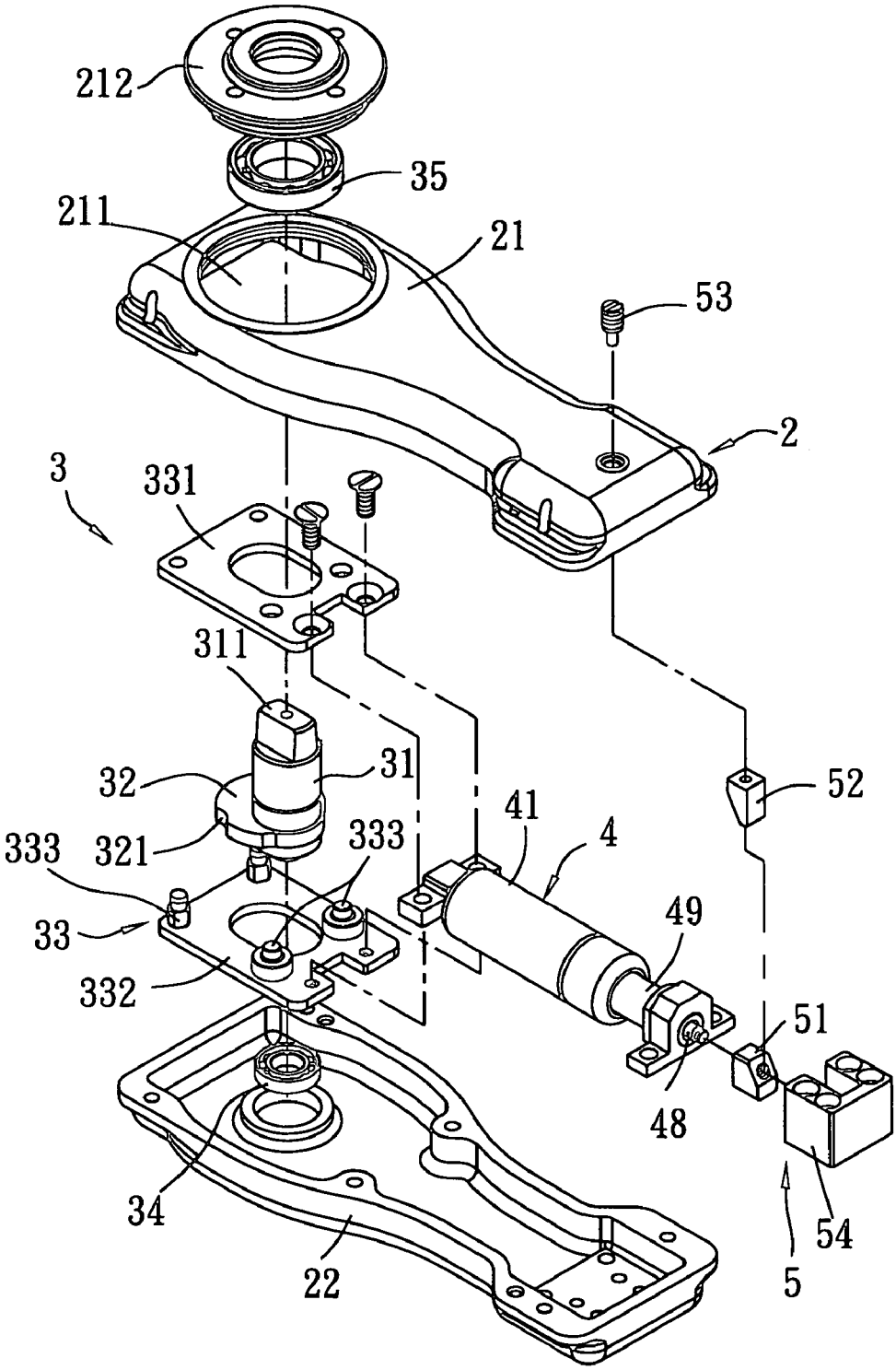
FIG. 1 is an exploded perspective view of the preferred embodiment of a door closer according to the present invention.
Figure 2:
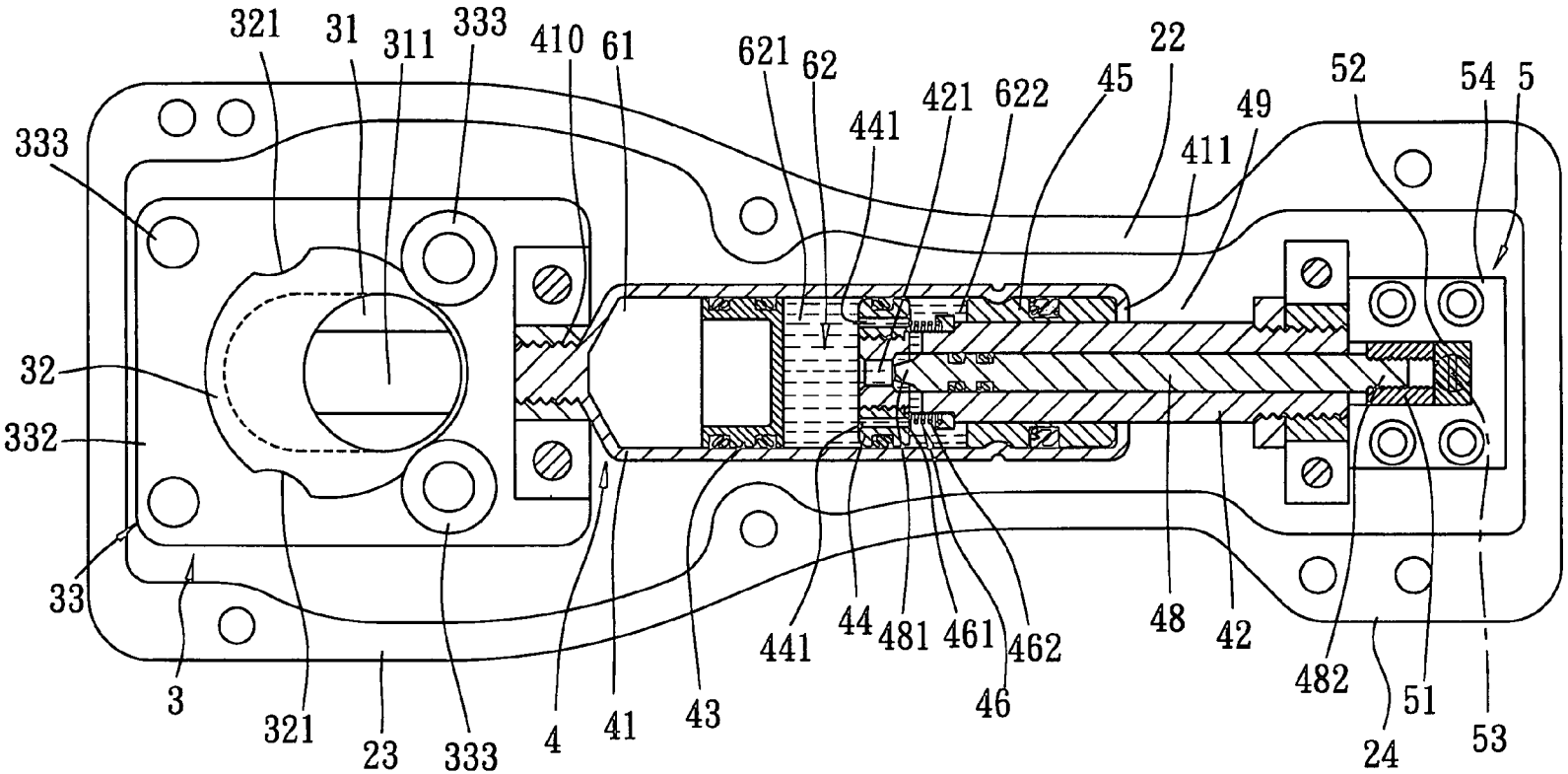
FIG. 2 is a schematic, partly sectional, top view of the preferred embodiment, illustrating a cam follower member in a closing position.
Figure 3:
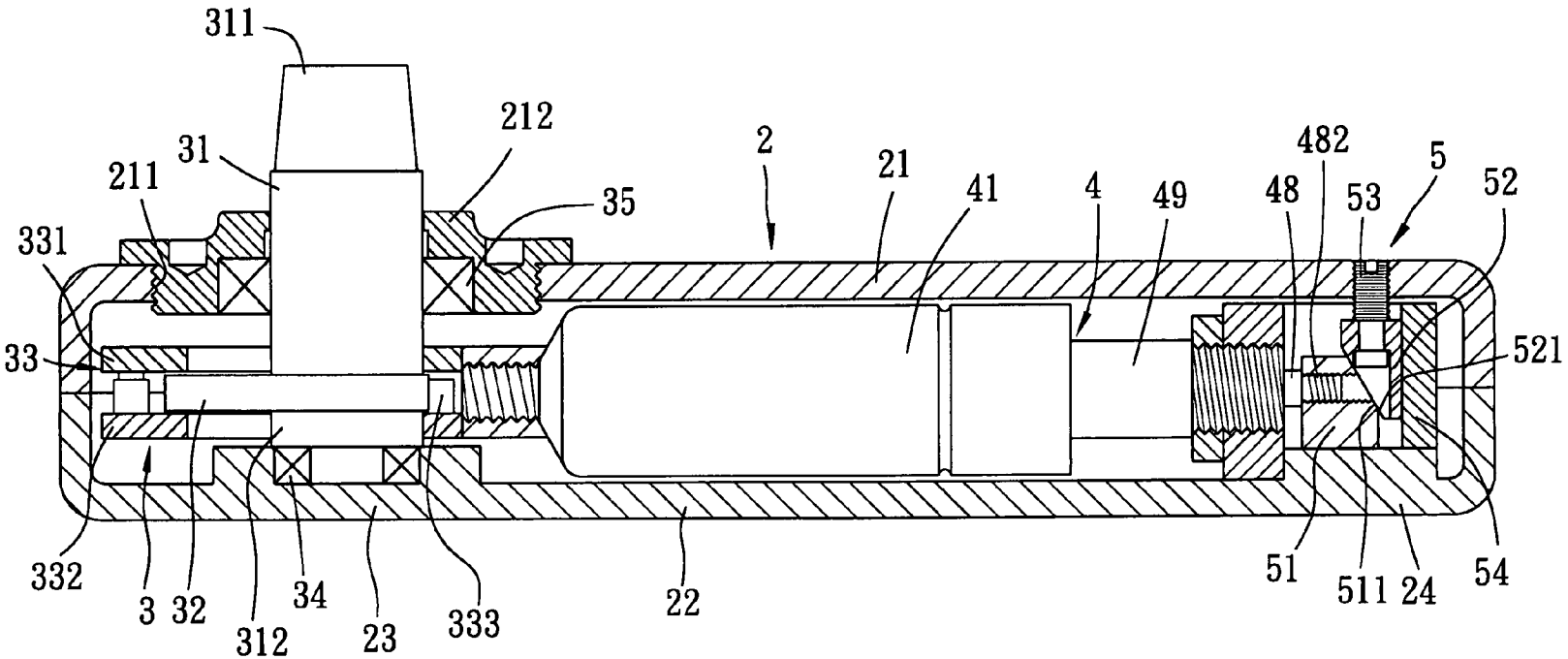
FIG. 3 is a schematic, longitudinal, partly sectional view of the preferred embodiment.

Referring to FIGS. 1 to 3, the preferred embodiment of a door closer according to the present invention is shown to include a closer casing 2, a pivot unit 3, and a length-variable damping cylinder 4.

The closer casing 2, which is to be secured beneath a door panel (not shown), includes a complementary pair of upper and lower casing portions 21, 22 that cooperate to form a casing space, and has first and second end portions 23, 24 opposite to each other in a longitudinal direction. The upper casing portion 21 is formed with a threaded circular hole 211 in the first end portion 23. The closer casing 2 further has a threaded ring cap 212 that is mounted threadedly in the circular hole 211.

Figure 5:
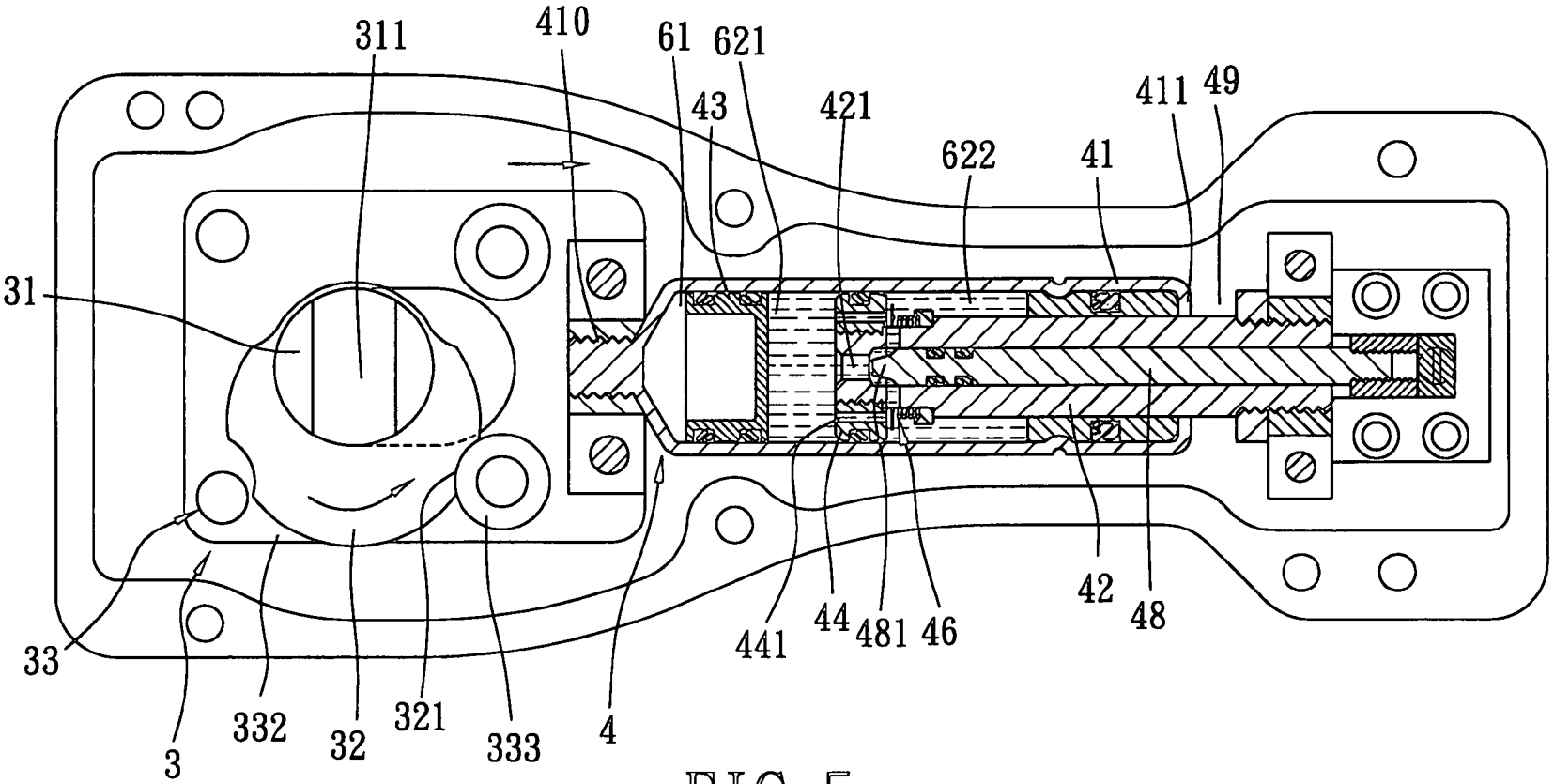
FIG. 5 is a view similar to FIG. 2, but illustrating the cam follower member in an open position.

The pivot unit 3 includes a pivot axle 31, a cam member 32, a cam follower member 33, and a pair of bearings 34, 35. The pivot axle 31 has a drive end portion 312 that extends into and that is retained rotatably in the first end portion 23 of the closer casing 2 by the bearings 34, 35, and a coupling end portion 311 that extends through the ring cap 212 and out of the closer casing 2. The coupling end portion 311 has a non-circular cross-section, and serves to couple co-rotatably with a bottom face of the door panel (not shown). The cam member 32 is mounted co-rotatably on the drive end portion 312 of the pivot axle 31. The cam follower member 33 is disposed in the closer casing 2, and is acted upon by the cam member 32 for moving along the longitudinal direction between open and closing positions upon rotation of the pivot axle 31, as best shown in FIGS. 2 and 5. In this embodiment, the cam member 32 is eccentric with respect to the pivot axle 31. The cam follower member 33 includes a pair of plates 331, 332 that sandwich the cam member 32 therebetween, and four connecting studs 333 that interconnect the plates 331, 332 and that are acted upon by the cam member 32. The cam member 32 has a periphery formed with positioning notches 321 to engage the connecting studs 333 for positioning releasably the cam follower member 33 at the open position, as best shown in FIG. 5.

The damping cylinder 4 is disposed in the closer casing 2, and has one end coupled to the cam follower member 33 and an opposite end anchored to the second end portion 24 of the closer casing 2. The damping cylinder 4 accumulates a restoring force upon movement of the cam follower member 33 from the closing position (see FIG. 2) to the open position (see FIG. 5), and releases the restoring force to assist movement of the cam follower member 33 from the open position back to the closing position.

In this embodiment, the damping cylinder 4 includes an outer tube 41, a first piston 43, a second piston 44, and a piston rod unit 49.

The outer tube 41 confines a tube space, and has a closed first end 410 and a second end 411 opposite to the closed first end 410 and having a closure member 45 mounted therein.

The first piston 43 is disposed in the outer tube 41, and partitions the tube space into a pneumatic chamber 61 filled with air, and a hydraulic chamber 62 filled with hydraulic fluid. The pneumatic chamber 61 is confined by the closed first end 410 and the first piston 43. The hydraulic chamber 62 is confined by the first piston 43 and the closure member 45.

The second piston 44 is disposed in the outer tube 41, and partitions the hydraulic chamber 62 into a first sub-chamber 621 and a second sub-chamber 622. With additional reference to FIG. 4, the second piston 44 has a first face 440 confronting the first piston 43, and a second face 442 confronting the closure member 45. The first sub-chamber 621 is confined by the first piston 43 and the first face 440 of the second piston 44. The second sub-chamber 622 is confined by the second face 442 of the second piston 44 and the closure member 45. The second piston 44 further has a plurality of first fluid passages 441 formed through the first and second faces 440, 442 for establishing fluid communication between the first and second sub-chambers 621, 622.

Figure 4:
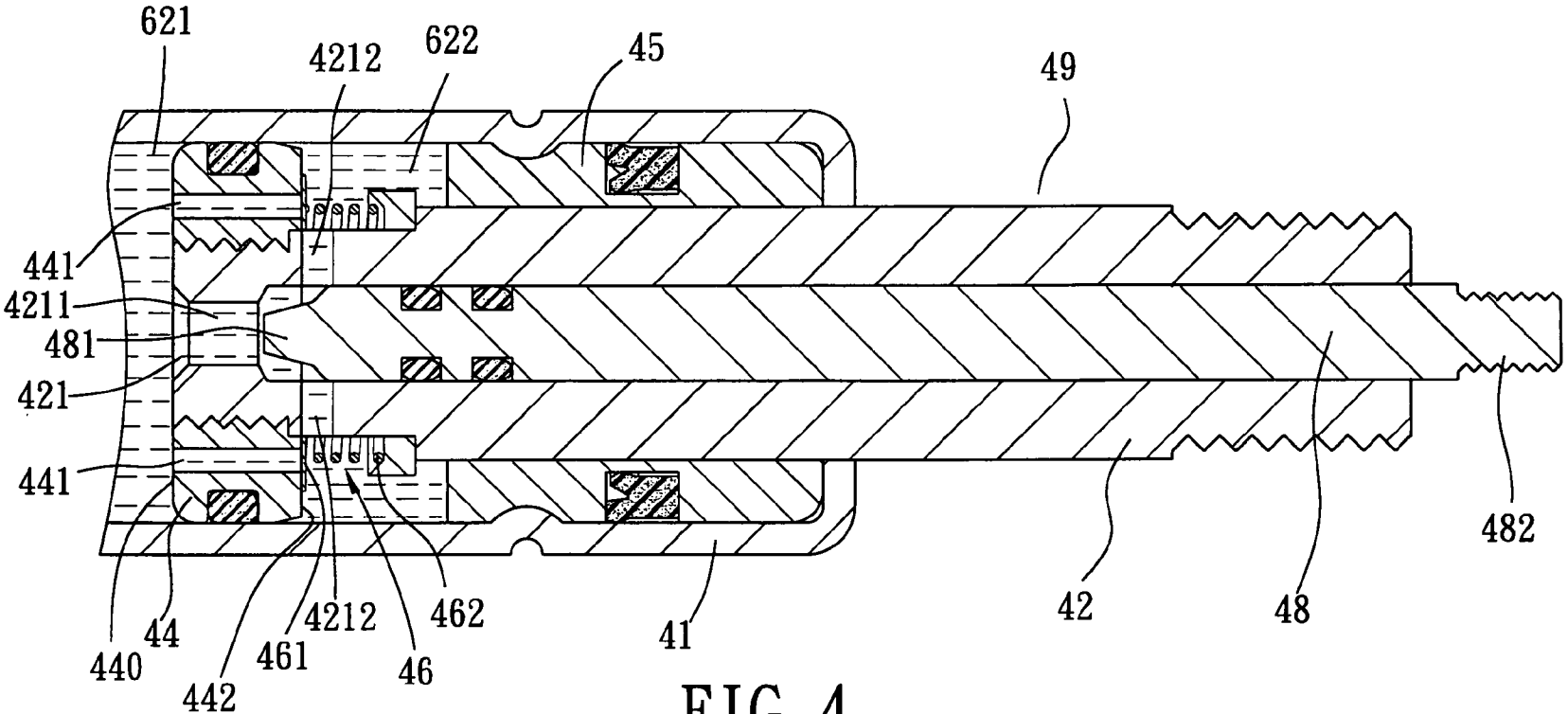
FIG. 4 is a fragmentary, schematic, sectional top view to illustrate a piston rod unit of a damping cylinder of the preferred embodiment.

The piston rod unit 49 has a first end portion connected to the second piston 44, and an opposite second end portion extending through the closure member 45 and disposed outwardly of the outer tube 41. The first end portion of the piston rod unit 49 is formed with a second fluid passage 421 that establishes fluid communication between the first and second sub-chambers 621, 622. In this embodiment, the piston rod unit 49 includes an inner tube 42 connected to the second piston 44, and a regulating rod 48 disposed slidably in the inner tube 42. As shown in FIG. 4, the second fluid passage 421 includes an axial portion 4211 in fluid communication with the first sub-chamber 621 and confined by the inner tube 42, and a radial portion 4212 in fluid communication with the second sub-chamber 622 and formed through the inner tube 42. The regulating rod 48 is slidable in the inner tube 42 so as to regulate amount of fluid flow through the axial and radial portions 4211, 4212 of the second fluid passage 421.

The damping cylinder 4 further includes a check valve 46 mounted on the first end portion of the piston rod unit 49, and operable so as to permit fluid flow from the first sub-chamber 621 to the second sub-chamber 622 through the first fluid passages 441 and so as to block fluid flow from the second sub-chamber 622 to the first sub-chamber 621 through the first fluid passages 441. As shown in FIG. 4, the check valve 46 includes a valve plate 461 sleeved on the inner tube 42 and disposed adjacent to the second face 442 of the second piston 44, and a biasing member 462 for biasing the valve plate 461 toward the second face 442 of the second piston 44.

Referring again to FIGS. 1 and 2, the closed first end 410 of the outer tube 41 extends between and is secured to the plates 331, 332 of the cam follower member 33. The regulating rod 48 includes a regulating end portion 481 for regulating fluid flow through the second fluid passage 421, and an adjusting end portion 482 anchored to the second end portion 24 of the closer casing 2. Preferably, the regulating end portion 481 is a tapered end portion.

The door closer further includes an adjusting unit 5 for mounting adjustably the adjusting end portion 482 of the regulating rod 48 in the closer casing 2. As shown in FIGS. 1 to 3, the adjusting unit 5 includes a first wedge 51 connected threadedly to the adjusting end portion 482 of the regulating rod 48 and having a first bevel surface 511, a second wedge 52 having a second bevel surface 521 in sliding contact with the first bevel surface 511, and a screw fastener 53 connected to the second wedge 52 and threadedly engaging the upper casing portion 21 of the closer casing 2. The adjusting unit 5 further includes a U-shaped retaining seat 54 mounted on the lower casing portion 22 at the second end portion 24 of the closer casing 2 and movably confining the first and second wedges 51, 52 therein. In operation, when the screw fastener 53 is threaded toward the lower casing portion 24, through the interaction of the second and first bevel surfaces 521, 511, the second wedge 52 will push the first wedge 51, thereby moving the regulating rod 48 away from the second end portion 24 of the closer casing 2 so as to reduce the amount of fluid flow through the axial and radial portions 4211, 4212 of the second fluid passage 421.

Operation of the preferred embodiment will now be described in greater detail in the following paragraphs.

Initially, as shown in FIG. 2, when a door panel (not shown) that is connected to the coupling end portion 311 of the pivot axle 31 is in a closed position, the cam follower member 33 is not acted upon by the cam member 32, and the damping cylinder 4 is thus in an initial uncompressed state.

Subsequently, when the door panel (not shown) is pivoted to move the same to an open position, the pivot axle 31 rotates at the same angle accordingly. When the pivot axle 31 rotates, the cam member 32 will co-rotate there with and act on the cam follower member 33 for moving the latter in the longitudinal direction to the open position (see FIG. 5). During this time, the outer tube 41 of the damping cylinder 4 moves in synchronization with the cam follower member 33. As such, air in the pneumatic chamber 61 will be compressed such that the damping cylinder 4 accumulates a restoring force upon movement of the cam follower member 33 from the closing position to the open position. At the same time, the first piston 43 will push the hydraulic fluid in the first sub-chamber 621 to flow into the second sub-chamber 622 through the first and second fluid passages 441, 421.

In design, due to the tapered regulating end portion 481 of the regulating rod 48, fluid flow through the second fluid passage 421 is much smaller than that through the first fluid passages 441. However, as the hydraulic fluid flows from the first sub-chamber 621 to the second sub-chamber 622, the valve plate 461 will be pushed away from the second piston 44, thereby compressing the biasing member 462, and thereby permitting fluid flow through the first fluid passages 441.

As shown in FIG. 5, when the cam follower member 33 is at the open position, one of the connecting studs 333 is registered with and engages one of the positioning notches 321, thereby positioning releasably the cam follower member 33 at the open position.

On the other hand, when the door panel (not shown) is pivoted to move the same back to the closed position, the force accumulated through air compression in the pneumatic chamber 61 will push the outer tube 41 to move the cam follower member 33 toward the closing position shown in FIG. 2. At this time, hydraulic fluid will flow from the second sub-chamber 622 to the first sub-chamber 621 solely through the second fluid passage 421. Fluid flow through the first fluid passages 441 is not permitted at this stage since the biasing member 462 urges the valve plate 461 toward the second face 442 of the second piston 44 so as to block fluid flow through the first fluid passages 441. Through adjustment of the regulating rod 48 via the adjusting unit 5, release of the accumulated force can progress at a desired pace during door closing movement.

In sum, this invention provides a door closer that does not require filling of the closer casing with hydraulic fluid. In addition, door closing action can proceed smoothly when the present invention is in use so as to prevent damage to a door structure due to banging and so as to extend the service life of the door structure.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A door closer comprising:

a closer casing having first and second end portions opposite to each other in a longitudinal direction;

a pivot unit including a pivot axle having a drive end portion that extends into and that is retained rotatably in said first end portion of said closer casing, and a coupling end portion that extends out of said closer casing, a cam member mounted co-rotatably on said drive end portion of said pivot axle, and a cam follower member disposed in said closer casing and acted upon by said cam member for moving along the longitudinal direction between open and closing positions upon rotation of said pivot axle;

a length-variable damping cylinder disposed in said closer casing and having one end coupled to said cam follower member and an opposite end anchored to said second end portion of said closer casing, said damping cylinder accumulating a restoring force upon movement of said cam follower member from the closing position to the open position, and releasing the restoring force to assist movement of said cam follower member from the open position back to the closing position;

wherein said damping cylinder includes:

an outer tube confining a tube space and having a closed first end, and a second end opposite to said closed first end and having a closure member mounted therein;

a first piston disposed in said outer tube and partitioning said tube space into a pneumatic chamber filled with air and a hydraulic chamber filled with hydraulic fluid, said pneumatic chamber being confined by said closed first end and said first piston, said hydraulic chamber being confined by said first piston and said closure member;

a second piston disposed in said outer tube and partitioning said hydraulic chamber into a first sub-chamber and a second sub-chamber, said second piston having a first face confronting said first piston and a second face confronting said closure member, said first sub-chamber being confined by said first piston and said first face of said second piston, said second sub-chamber being confined by said second face of said second piston and said closure member, said second piston further having a plurality of first fluid passages formed through said first and second faces for establishing fluid communication between said first and second sub-chambers; and a piston rod unit having a first end portion connected to said second piston, and an opposite second end portion extending through said closure member and disposed outwardly of said outer tube.

2. The door closer as claimed in claim 1, wherein said first end portion of said piston rod unit is formed with a second fluid passage that establishes fluid communication between said first and second sub-chambers, said damping cylinder further including a check valve mounted on said first end portion of said piston rod unit and operable so as to permit fluid flow from said first sub-chamber to said second sub-chamber through said first fluid passages and so as to block fluid flow from said second sub-chamber to said first sub-chamber through said first fluid passages.

3. The door closer as claimed in claim 2, wherein said piston rod unit includes an inner tube connected to said second piston and a regulating rod disposed slidably in said inner tube, said second fluid passage including an axial portion in fluid communication with said first sub-chamber, and a radial portion in fluid communication with said second sub-chamber, said regulating rod being slidable in said inner tube so as to regulate amount of fluid flow through said axial and radial portions of said second fluid passage.

4. The door closer as claimed in claim 3, wherein said check valve includes a valve plate sleeved on said inner tube and disposed adjacent to said second face of said second piston, and a biasing member for biasing said valve plate toward said second face of said second piston.

5. The door closer as claimed in claim 3, wherein said closed first end of said outer tube is secured to said cam follower member, and said regulating rod includes a regulating end portion for regulating fluid flow through said second fluid passage, and an adjusting end portion anchored to said second end portion of said closer casing.

6. The door closer as claimed in claim 5, wherein said regulating end portion is a tapered end portion.

7. The door closer as claimed in claim 5, further comprising an adjusting unit for mounting adjustably said adjusting end portion of said regulating rod in said closer casing.

8. The door closer as claimed in claim 7, wherein said adjusting unit includes:

a first wedge connected to said adjusting end portion of said regulating rod and having a first bevel surface;

a second wedge having a second bevel surface in sliding contact with said first bevel surface; and a screw fastener connected to said second wedge and threadedly engaging said closer casing.

9. The door closer as claimed in claim 8, wherein said adjusting unit further includes a retaining seat mounted in said second end portion of said closer casing and movably confining said first and second wedges therein.

10. The door closer as claimed in claim 1, wherein said cam member is eccentric with respect to said pivot axle, said cam follower member including a pair of plates that sandwich said cam member therebetween, and a plurality of connecting studs that interconnect said plates and that are acted upon by said cam member.

11. The door closer as claimed in claim 10, wherein said cam member has a periphery formed with a positioning notch that engages one of said connecting studs for positioning releasably said cam follower member at the open position.

* * * * *